United States Patent [19]

Banks

[11] 3,991,771

[45] Nov. 16, 1976

[54] APPARATUS FOR DEPOSITION OF FLAVORANT VAPOR ON TOBACCO

[75] Inventor: Jon F. Banks, Louisville, Ky.

[73] Assignee: Brown & Williamson Tobacco Corporation, Louisville, Ky.

[22] Filed: Feb. 11, 1975

[21] Appl. No.: 549,086

[52] U.S. Cl. ..... 131/134; 131/144

[51] Int. Cl.[2] ..... A24B 15/04

[58] Field of Search ..... 131/133, 134, 135, 136, 131/138, 140 R, 144; 126/374, 348, 343.5; 34/10, 36, 37, 57

[56] References Cited

UNITED STATES PATENTS

| | | | |
|---|---|---|---|
| 628,394 | 7/1899 | Couty | 126/348 |
| 1,499,852 | 7/1924 | Cerini | 126/348 |
| 2,820,134 | 1/1958 | Kobayashi | 126/374 X |
| 3,256,904 | 6/1966 | Costa et al. | 126/348 X |
| 3,364,844 | 1/1968 | Felske | 126/374 X |
| 3,364,936 | 1/1968 | Axelrod | 131/144 |
| 3,419,015 | 12/1968 | Wochnowski | 131/138 |
| 3,548,838 | 12/1970 | Key | 131/144 |
| 3,677,269 | 7/1972 | Hudson | 131/134 |
| 3,678,939 | 7/1972 | Key et al. | 131/144 |
| 3,800,806 | 4/1974 | Banks | 131/144 |

*Primary Examiner*—Robert W. Michell
*Assistant Examiner*—V. Millin
*Attorney, Agent, or Firm*—William J. Mason

[57] ABSTRACT

An improvement is provided in an apparatus having an air flow system into which tobacco is injected for treatment with a flavorant and withdrawn after contact with the flavorant carried by the air flow system. The apparatus is provided with a vaporizer for vaporizing molten flavorant into the air flow by spray injecting molten flavorant countercurrently into a flow of heated air. The apparatus is also provided with an analyzer downstream of the vaporizing means for determining the amount of flavorant vapor in the air flow. A regulator is connected to the vaporizer for regulating the amount of flavorant injected into the air flow in response to the determination made by the analyzer of the level of flavorant vapor contained in the air flow.

16 Claims, 4 Drawing Figures

APPARATUS FOR DEPOSITION OF FLAVORANT VAPOR ON TOBACCO

The present invention relates to an apparatus for effecting the adsorption of a flavorant vapor onto tobacco.

More particularly, this invention relates to an apparatus for deposition of menthol vapor on tobacco.

More particularly, this invention relates to an apparatus having an air flow system into which tobacco is injected for treatment with a flavorant vapor and withdrawn after contact with the flavorant vapor carried by the air flow system.

In the past, the application of flavorants, including menthol, to tobacco has often been a rather haphazard operation. In general, menthol has been applied to tobacco by first forming a diluted menthol solution and thereafter spraying the solution onto tobacco. It is well known that during spraying operations, tobacco is contacted only by discrete spray droplets of menthol solution. Such droplets are not uniformly distributed over the surface of the tobacco with the result that conventional spraying operations do not, for the most part, provide uniform deposition of menthol. The disadvantages in the methods for applying flavorants onto tobacco in the past are set forth in U.S. Pat. No. 3,800,806. The method, disclosed in this patent, provides for uniformly treating tobacco with flavorant vapors, such as menthol vapor.

In order to apply a method of vapor deposition of menthol to tobacco, an apparatus is required that does not contain the deficiencies used in the past in the liquid deposition apparatus. In applying the prior art methods of tobacco flavoring, apparatus have been provided to sprinkle additives in a liquid state onto successive increments of tobacco which are being advanced through a mixing zone. The prior art discloses apparatus which mix liquid solutions with the tobaco directly in a mixing zone. Substantial deficiencies appear in those apparatus in that they are not adapted for the vaporization method where a molten flavorant is vaporized in a heated air flow and is then carried pneumatically in vapor form into contact with tobacco for adsorption thereon.

An additional defect of the prior art art apparatus for tobacco flavoring lies in the failure of apparatus to regulate the level of menthol applied to tobacco in a continuous processing operation. No tobacco flavoring apparatus has been proposed to immediately monitor the amount of menthol applied to tobacco and to rapidly compensate for any variation therein. When variations in tobacco flow or menthol solution do occur in apparatus shown in the prior art, a lag period usually occurs for the adjustment of the amount of liquid flow into the mixing zone. Furthermore, the flow of tobacco into the mixing zone was also a significant factor in affecting the amount of menthol solution deposited on the tobacco.

The following prior art was reviewed but was not considered to disclose the features of the invention described herein: U.S. Pat. No. 3,419,015; U.S. Pat No. 3,575,178; U.S. Pat. No. 3,738,341; U.S. Pat. No. 3,799,179; and U.S. Pat. No. 3,842,846.

Accordingly, it is a primary object of this invention to provide a new and improved apparatus for vaporization of a molten flavorant into an air flow for treatment of tobacco.

It is a further object of this invention to provide an apparatus having an air flow system into which tobacco is injected for effecting adsorption of flavorant vapors onto the tobacco and from which tobacco is withdrawn after contact with the flavorant carried by the air flow system.

It is a further object of this invention to provide a new and improved apparatus for treating tobacco with flavorant in vapor form without utilizing a carrier liquid for the flavorant.

Another object of this invention is to provide an apparatus for adsorption of flavorant vapor onto tobacco at temperatures compatible with tobacco processing.

Another object of this invention is to provide an apparatus which conveys and maintains a consistent amount of flavorant vapor in the air flow for treatment with the tobacco during a continuous processing operation.

It is also an object of this invention to provide an apparatus which conveys a consistent amount of flavorant vapor to the tobacco in an air flow system by analyzing the amount of flavorant vapor in the air flow prior to contact with the tobacco downstream of the injection of flavorant vapor into the air flow and regulating the amount of flavorant injected into the system in response to the analyzation.

A further object of this invention is to provide an apparatus for achieving a complete vaporization of a molten flavorant into the air flow.

Additional objectives and advantages of the invention will be set forth in part in the description which follows, and in part will be obvious from the description, or may be learned by practice of the invention. The objectives and advantages of the invention may be realized and attained by means of the instrumentalities and combinations particularly pointed out in the appended claims.

SUMMARY OF THE INVENTION

To achieve the foregoing objectives and in accordance with the purpose of the invention, as embodied and broadly described herein, this invention relates to an apparatus comprising an air flow system into which tobacco is injected for effecting adsorption of a flavorant vapor onto the tobacco and withdrawn after contact with the flavorant carried by the air flow system, means for vaporizing a molten flavorant in the air flow system including means for injecting said molten flavorant countercurrently into the said air flow, means operatively connected to the vaporizing means for regulating the quantity of flavorant injected into the air flow, analyzing means in communication with the air flow downstream of the vaporizing means for analyzing the quantity of flavorant in the air flow, and means connecting the regulating and the analyzing means such that the regulating means varies the quantity of flavorant injected in response to the level of flavorant contained in the air flow.

DESCRIPTION OF THE DRAWINGS

The invention consists in the novel parts, constructions, arrangements, combinations and improvements shown and described. The accompanying drawings, which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
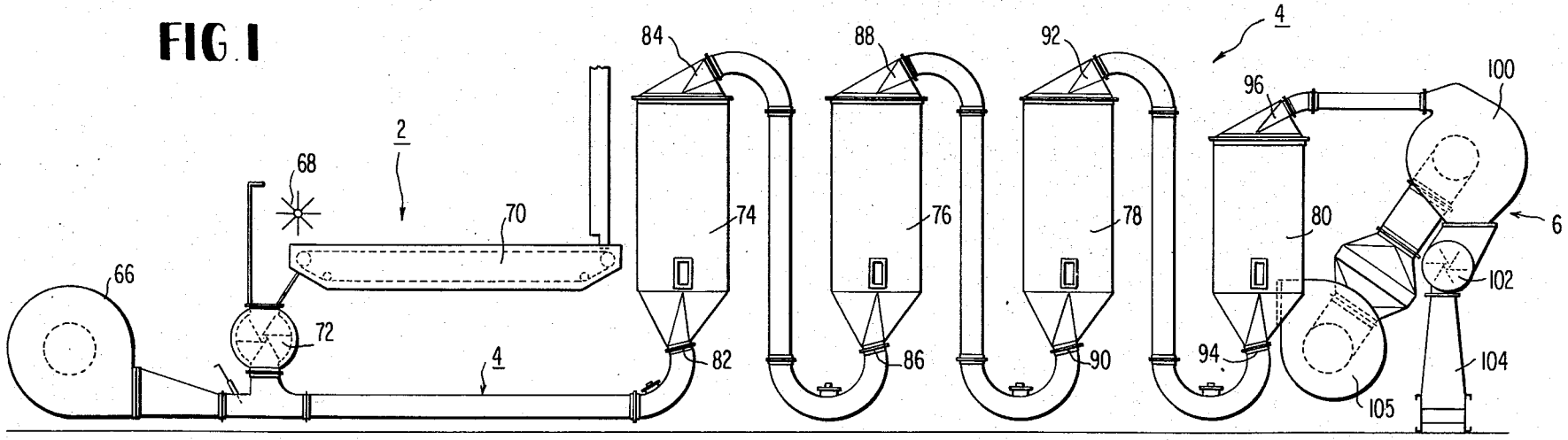
FIG. 1 is a side view of the apparatus showing the portion of the air flow system with the tobacco injection means, the conduit for treatment of the tobacco with the flavorant vapor, and the tobacco ejection means.

Referring now to FIG. 1, it may be seen that the apparatus includes an air flow system having means 2 for injecting tobacco into the air flow for treatment with a flavorant, a conduit 4 in the air flow system for effecting adsorption of flavorant vapor onto the tobacco, and means 6 for ejecting the tobacco from the air flow system after contact with the flavorant.

In accordance with the invention, the apparatus further comprises means for vaporizing a molten flavorant in the air flow system including means for injecting the molten flavorant countercurrently into the air flow, means operatively connected to the vaporizing means for regulating the quantity of flavorant injected into the air flow, analyzing means in communication with the air flow downstream of the vaporizing means for analyzing the quantity of flavorant in the air flow, and means connecting the regulating and analyzing means such that the regulating means varies the quantity of flavorant injected in response to the level of flavorant contained in the air flow.

Figure 2:
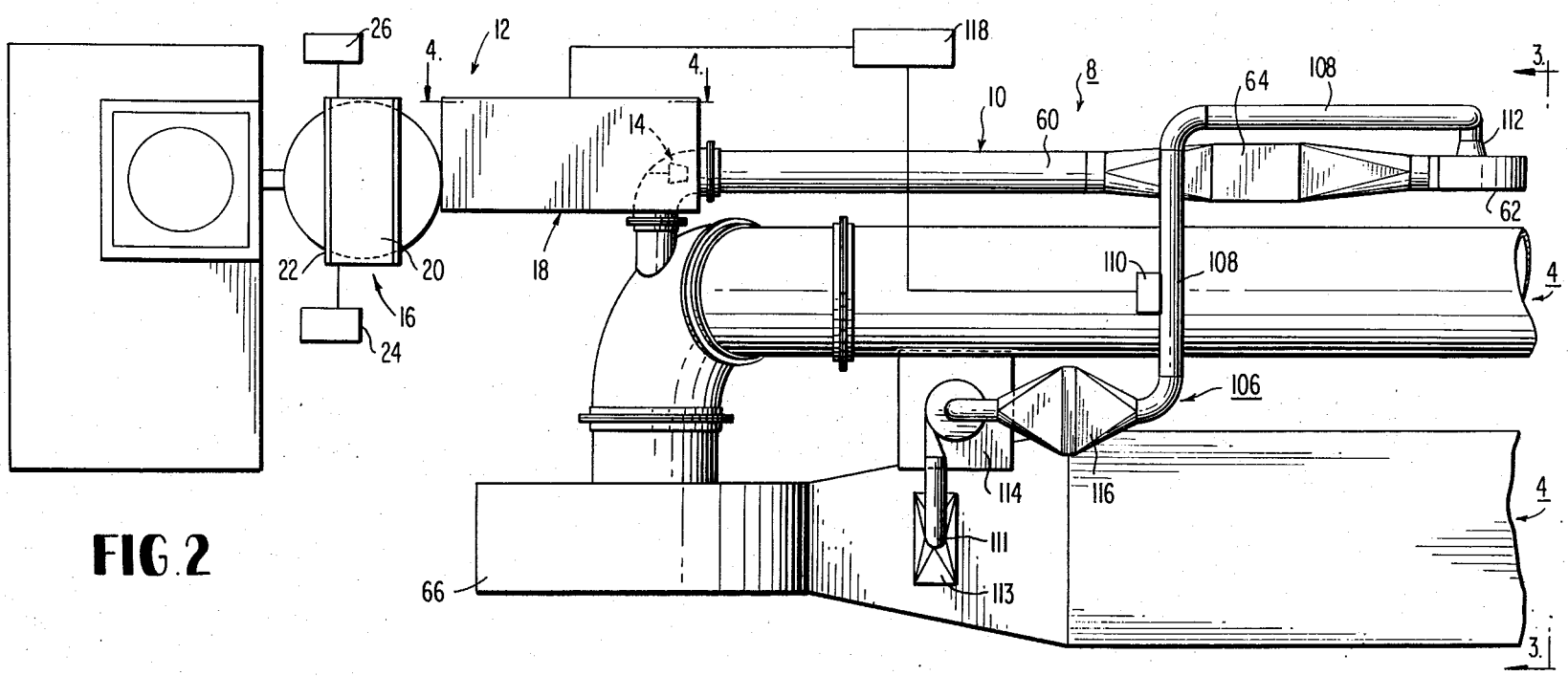
FIG. 2 is a perspective view of the apparatus showing the portion of the air flow system with the vaporizing means and analyzing means.

Referring to FIG. 2, as herein embodied, the vaporizing means generally shown as 8 includes means 10 for delivering a heated air flow, means 12 for delivering molten flavorant, and nozzle means 14 which is connected to the delivery means 12 and mounted for spray injecting molten flavorant into the heated air flow countercurrently to the flow of the heated air.

It is preferred that the molten flavorant be initially in a crystalline form and, in the embodiment disclosed, the means 12 for delivering molten flavorant includes means 16 for melting crystalline flavorant and means 18 connected between the melting means 16 and the nozzle means 14 for transporting the molten flavorant from the melting means 16 to the nozzle means 14.

Referring to FIG. 2, the melting means generally shown as 16 employs a kettle 20 with a steam-heating jacket 22 for melting crystalline flavorants. A conventional temperature control 24 is operatively connected to the kettle 20. This control 24 regulates the flow of steam into the heating jacket of the kettle 20 so that the flavorant in the kettle 20 is melted as well as being kept from becoming too hot. A conventional control means 26 may also be connected to kettle 20 for regulating the amount of crystalline flavorant delivered to kettle 20.

Figure 4:
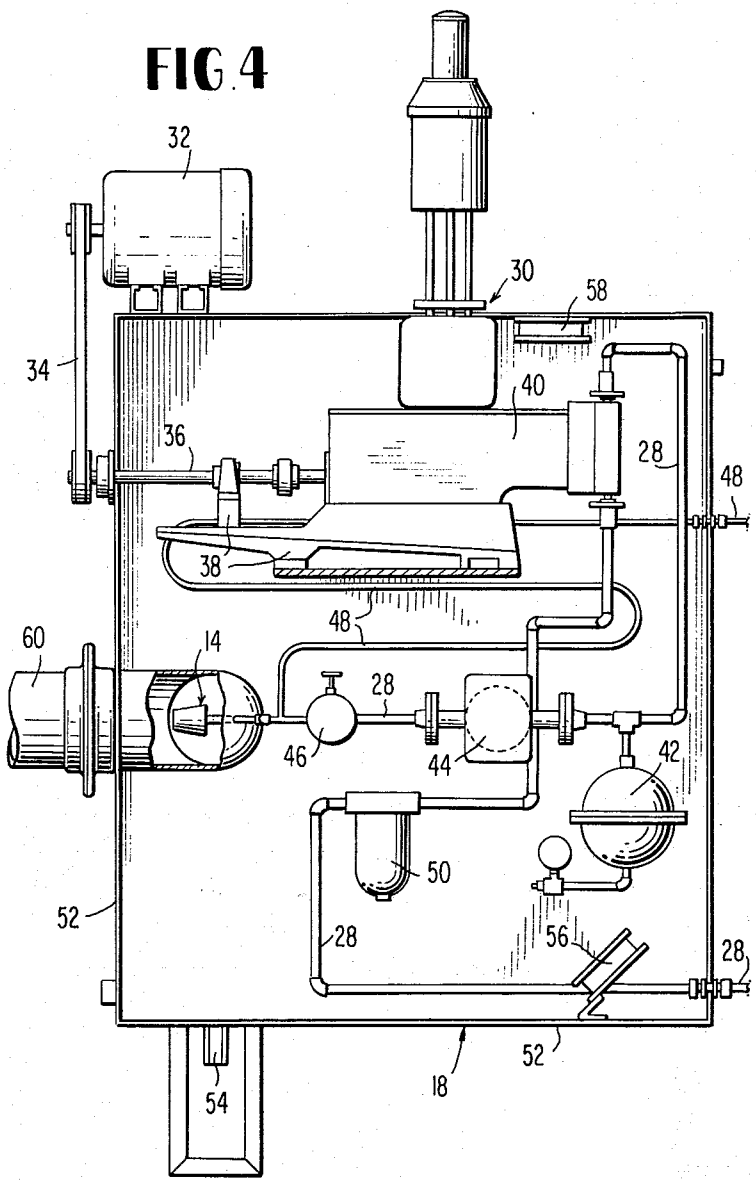
FIG. 4 is a view of the apparatus taken along line 4—4 of FIG. 3 showing the details of the vaporizing means, including the means for injecting molten flavorant into the air flow system.

Referring to FIG. 4, the transport means generally shown as 18 includes a pipe system 28 provided to carry the molten flavorant from kettle 20 to the nozzle means 14. The molten flavorant is forced through pipe system 28 by pump 30. The pump 30 includes a motor 32 with a timing belt 34 connected to a drive shaft 36. The drive shaft 36, supported by element 38, drives the pump. The pump 30, connected to pipe system 28 at pump chamber 40, provides the pressure flow necessary to carry the molten flavorant from the kettle 20 through the pipe system 28 to the nozzle means 14.

It is preferred in the disclosed embodiment, that the pump 30 be a variable stroke pump to provide flow regulation. In this respect, a dampener 42 of a conventional bladder type is connected in the pipe system 28 after pump 30 for leveling out the pressure flow pulsations of the molten flavorant. A flow meter 44 is positioned downstream of pump 30 to monitor the flow of molten flavorant supplied to the nozzle means 14. A back pressure regulator 46 is provided between the flow meter 44 and the nozzle means 14 to insure that the pressure flow of the molten flavorant is maintained. A line 48 is provided for supplying air to the nozzle means 14 for atomization. A strainer 50 is also provided in the pipe system 28 upstream of the pump 30 to remove any foreign particles from the molten flavorant. This prevents the pump 30, nozzle means 14, or the flow meter 44 from becoming clogged.

Referring to FIG. 4, it may also be seen that the transport means 18 is contained in a cabinet 52. As previously noted, the transport means 18 is conveying molten flavorant from the melting means 16 to the nozzle means 14. Therefore, it is advantageous to maintain a temperature in cabinet 52 above the melting point of the flavorant being transported. In the disclosed embodiment, electrical heaters 54 are provided to heat the air in cabinet 52. Blower 56 is provided to circulate the air within the cabinet 52 so that all areas of cabinet 52 are maintained at a temperature above the melting point of the flavorant. A blower 58 is provided for exhaust purposes. Since the temperature in cabinet 52 is above the melting point of the flavorant, the pump motor 32 and the timing belt 34 are located outside cabinet 52.

Referring to FIG. 2, in the embodiment disclosed, it is preferred that the means for delivering a heated air flow generally shown as 10 include an air intake duct 60 with a fan 62 located therein for forcing air into duct 60. The intake air is fed through a heater 64 located in duct 60 downstream of fan 62. This heater 64 heats the air to a temperature sufficient to vaporize the molten flavorant when it is fed into the duct 60 at nozzle means 14.

In accordance with the invention, nozzle means 14 is connected to the delivery means 12 and mounted for spray injecting molten flavorant into the air flow. Referring to FIG. 4, in the preferred embodiment disclosed, nozzle means 14 is connected to pipe system 28 to receive a flow of molten flavorant from kettle 20.

Nozzle means 14 is mounted so that the spray of molten flavorant is directed against the heated air flow in duct 60. The melted flavorant is directed against the heated air flow in duct 60. The melted flavorant is therefore evenly distributed into and completely vaporized by the heated air flow. Injecting molten flavorant by nozzle means 14 countercurrent to the heated air flow provides a complete vaporization operation and prevents non-vaporized flavorant from entering the air flow system.

In the embodiment disclosed, the heated air flow with the flavorant vapor is carried by duct 60 into the air flow system, specifically conduit 4. The air flow with the flavorant vapor is pneumatically conveyed past the means 2 for injecting tobacco into the air flow and through conduit 4 for effecting adsorption of the flavorant vapor onto the tobacco. It is preferred that a fan 66 be located downstream of the nozzle means 14 to pneumatically convey the air and flavorant vapor through the system.

The tobacco injection means 2 is positioned at the outlet side of fan 66 so that the tobacco is dispersed into the pneumatic stream of heated air and flavorant vapor and carried through conduit 4. Various tobacco injection means could be utilized in this apparatus. As shown in FIG. 1, the preferred embodiment employs a weight conveyor 70 with a pin doffer 68 at its discharge to a rotary air lock 72. The air lock 72 disperses the tobacco into the air flow.

In the preferred embodiment shown in FIG. 1, the conduit 4 for effecting adsorption of the flavorant vapor onto the tobacco includes a series of elements defining chambers 74, 76, 78, 80 which have openings 82 and 84, 86 and 88, 90 and 92, 94 and 96 at the lower and upper ends, respectively, so that the air flow enters each chamber at the lower end and exits at the upper end. The chambers 74, 76, 78, 80 are constructed so that the tobacco being carried by the air flow spreads outwardly in the chambers at a slower speed than conveyed in the other portions of conduit 4. This operation separates the tobacco particles, exposes all the surfaces of the tobacco to the flavorant vapor, and allows sufficient contact time between the flavorant vapor and tobacco to enhance adsorption of the flavorant vapor onto the tobacco.

In the preferred embodiment shown in FIG. 1, tobacco ejection means 6 is connected to conduit 4 at the end of the series of chambers 74, 76, 78, 80. Various tobacco ejection means may be employed, as for instance, a classifier 100 separating the tobacco from the air flow and connected to a rotary air lock 102 for ejecting the tobacco into a conveyor 104.

Since conduit 4 is constructed in a closed-loop air flow system, the air flow and any unadsorbed vapor passing through tobacco ejection means 6 is carried back through conduit 4 towards the vaporizer means 12. A fan 105 is located in conduit 4 at tobacco ejection means 6 to force the air flow back through the system.

In accordance with the invention, an analyzing means is provided in communication with the air flow downstream of the vaporizing means for analyzing the quantity of flavorant in the air flow. Various types of analyzing means could be employed.

Figure 3:
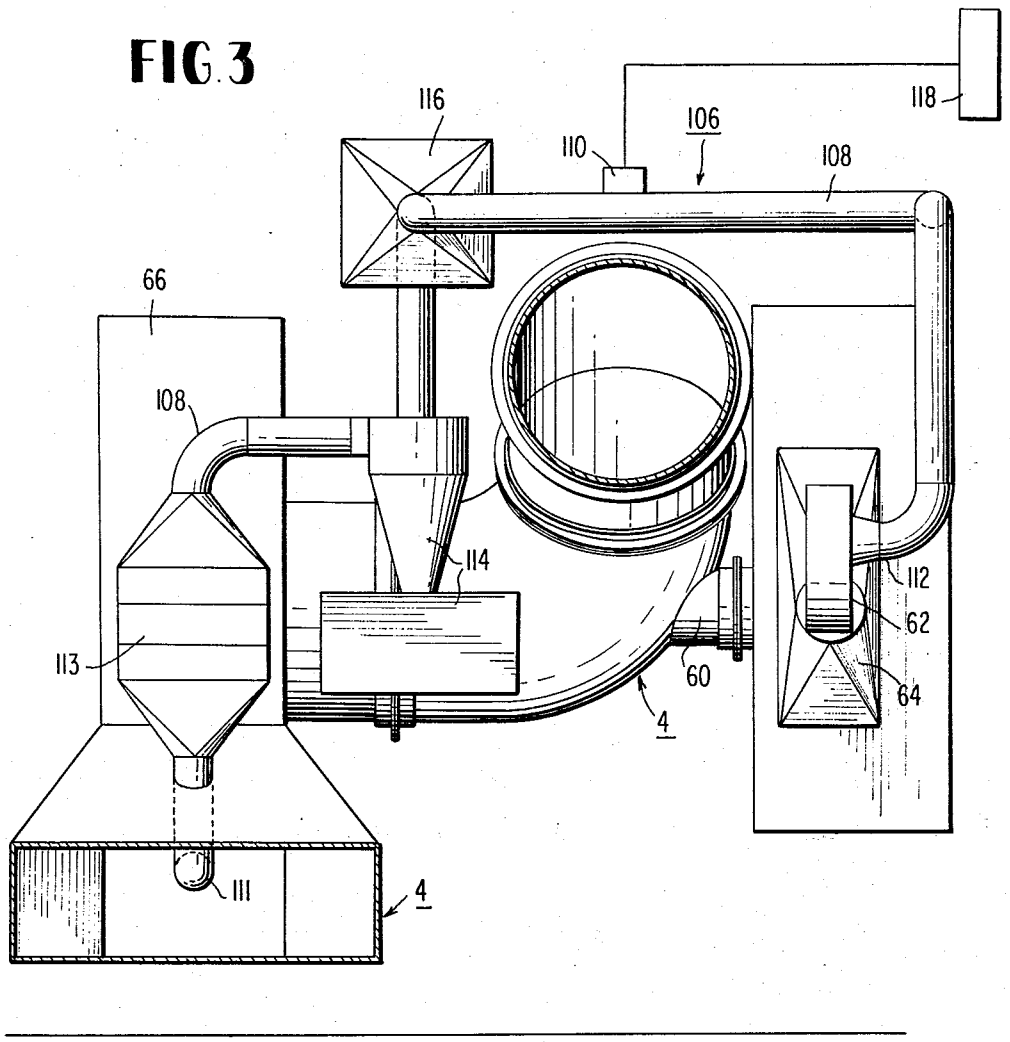
FIG. 3 is a view of the apparatus taken along line 3—3 of FIG. 2 showing the portion of the air flow system with the vaporizing means and analyzing means.

As shown in FIGS. 2 and 3, a by-pass air flow means generally shown as 106 is provided in the preferred embodiment. A by-pass conduit 108 is connected at one end 111 into the air flow system downstream of vaporizing means for receiving a sample of the air flow with the flavorant vapor. The other end 112 of conduit 108 is connected upstream of the nozzle means 14 for recycling the air sample into the heated air flow of intake duct 60.

A total hydrocarbon analyzer 110 is employed in by-pass conduit 108 for accurately and rapidly determining the amount of flavorant vapor in the air flow sample. In order to further enhance an accurate reading of the level of flavorant vapor in the air flow by an analyzer of this type, a heating mechanism, such as steam coils 113, is located in the by-pass conduit 108 upstream of the analyzer 110. Reheating of the air flow sample prevents the flavorant vapor carried in the sample from condensing in by-pass conduit 108 before reaching analyzer 110. It is also preferred to incorporate a filter means comprising a miniature separator 114 with an air tight box and a pad filter 116 for removing dust and foreign particles that are located upstream of analyzer 110. This prevents any foreign particles from being conveyed into the total hydrocarbon analyzer 110 and further ensures an accurate reading of the level of flavorant vapor in the air flow sample by the analyzer.

In accordance with the invention, means are provided for regulating the quantity of molten flavorant injected into the air flow. Various devices could be employed for regulating the flow of molten flavorant supplied to nozzle means 14. In the preferred embodiment, variable stroke pump 30 previously noted can be utilized not only to supply a steady flow of molten flavorant to the nozzle means 14, but also to regulate the quantity of flow of molten flavorant supplied to the nozzle means 14 for injection into the air flow. This is accomplished by varying the stroke of pump 30, which in turn increases or decreases pressure flow of the molten flavorant to nozzle means 14 through pipe system 28.

In accordance with the invention, means are connected between the regulating means and the analyzing means so that the regulating means varies the quantity of flavorant injected in response to the level of flavorant contained in the air flow. Referring now to FIGS. 2 and 3, it may be seen that a conventional process controller 118 is connected to total hydrocarbon analyzer 110 so that a signal is received by the process controller 118 from analyzer 110 that corresponds to the level of flavorant vapor detected in the air flow sample. The process controller 118 is programed to adjust the stroke of pump 30 to reflect variations in the analyzer signal. Therefore, when the process controller 118 receives a signal from the analyzer indicating an amount of flavorant vapor in the air flow below a predetermined base level, the process controller 118 increases the strokes of pump 30 and therefore increases the flow of molten flavorant to nozzle means 14 for injection into the air flow. Likewise, if the signal from the analyzer 110 indicates a level of flavorant above the predetermined base level, the process controller 118 decreases the strokes of pump 30 and therefore decreases the flow of molten flavorant to nozzle means 14.

The accurate monitoring and control of the amount of flavorant vapor in the air flow is significant in providing a uniform adsorption of flavorant onto the tobacco during a continuous processing operation. By use of the control system, the impact of a possible feed fluctuation of the tobacco into the air flow system is also reduced.

It will be apparent to those skilled in the art that various modifications and variations could be made in the apparatus of the invention without departing from the scope or spirit of the invention.

What is claimed is:

1. An apparatus including an air flow system into which tobacco is injected for treatment with a flavorant and withdrawn after contact with said flavorant carried by said air flow system, comprising the improvement of:

a. means for vaporizing a molten flavorant into said air flow system including means for injecting said molten flavorant countercurrently into said air flow;

b. means operatively connected to said vaporizing means for regulating the quantity of flavorant injected into said air flow;

c. analyzing means in communication with said air flow downstream of said vaporizing means for analyzing the quantity of flavorant in said air flow; and d. means operatively connected to said regulating means and said analyzing means for controlling said regulating means for varying the quantity of flavorant injected in response to the quantity of flavorant in the air flow analyzed by said analyzing means.

2. An apparatus recited in claim 1, wherein said vaporizing means comprises means for delivering a heated air flow, means for delivering molten flavorant, and nozzle means, operatively connected to said means for delivering molten flavorant and operatively mounted to said means for delivering a heated air flow for spray injecting the molten flavorant into said heated air flow countercurrently to the flow of the heated air.

3. An apparatus recited in claim 2, wherein said means for delivering molten flavorant comprises means for melting crystalline flavorant and means, operatively connecting said melting means and said nozzle means, for transporting said molten flavorant from said melting means to said nozzle means.

4. An apparatus recited in claim 3, wherein said melting means includes a kettle with a steam-heating jacket for melting crystalline flavorants, temperature control means for regulating the flow of steam into the heating jacket of said kettle, and control means, operatively connected to said kettle, for regulating the amount of crystalline flavorant delivered to said kettle.

5. An apparatus recited in claim 3, wherein said transport means comprises a pipe for carrying said molten flavorant from said melting means to said nozzle means, a pump connected with said pipe to force the molten flavorant from said melting means to said nozzle means, and a strainer connected in said pipe between said melting means and said pump to eliminate foreign particles from the molten flavorant.

6. An apparatus recited in claim 3, wherein said transport means is contained in a heated cabinet so that the flavorant is maintained at a temperature above its melting point during transport to said nozzle means.

7. An apparatus recited in claim 1, wherein said analyzing means comprises a by-pass air flow means connected at one end into said air flow system downstream of said vaporizing means for receiving a portion of said air flow and connected at the other end upstream of said vaporizing means for delivering said portion back into said air flow system, said by-pass means having steam coils for reheating said portion of the air flow and an analyzer means operatively connected into said by-pass air flow means for analyzing the amount of flavorant vapor contained in said air flow and transmitting a signal to said regulating means.

8. An apparatus including an air flow system into which tobacco is injected for treatment with a flavorant and withdrawn after contact with said flavorant carried by said air flow system, comprising the improvement of:

a. means for delivering a heated air flow;

b. means for delivering molten flavorant;

c. nozzle means, operatively connected to said means for delivering molten flavorant and operatively mounted to said means for delivering a heated air flow for spray injecting the molten flavorant into said heated air flow countercurrently to the flow of the heated air.

9. An apparatus recited in claim 8, wherein said means for delivering molten flavorant comprises means for melting crystalline flavorant and means, operatively connecting said melting means and said nozzle means, for transporting said molten flavorant from said melting means to said nozzle means.

10. An apparatus recited in claim 9, wherein said melting means includes a kettle with a steam-heating jacket for melting crystalline flavorant, temperature control means for regulating the flow of steam into the heating jacket of said kettle, and control means, operatively connected to said kettle, for regulating the amount of crystalline flavorant delivered to said kettle.

11. An apparatus recited in claim 9, wherein said transport means comprises a pipe for carrying said molten flavorant from said melting means to said nozzle means, a pump connected with said pipe to force the molten flavorant from said melting means to said nozzle means, and a strainer connected in said pipe between said melting means and said pump to eliminate foreign particles from the molten flavorant.

12. An apparatus recited in claim 9, wherein said transport means is contained in a heated cabinet so that the flavorant is maintained at a temperature above its melting point during transport to said nozzle means.

13. An apparatus recited in claim 8, including means, operatively connected to said means for delivering molten flavorant, for regulating the amount of molten flavorant delivered to said nozzle means.

14. An apparatus recited in claim 13, wherein said improvement further includes analyzing means in communication with said air flow downstream of said nozzle means for analyzing the quantity of flavorant in said air flow; and means operatively connected to said regulating means and said analyzing means for controlling said regulating means for varying the quantity of flavorant injected in response to the quantity of flavorant in the air flow analyzed by said analyzing means.

15. An apparatus including an air flow system into which tobacco is injected for treatment with a flavorant and withdrawn after contact with said flavorant carried by said air flow system, comprising the improvement of:

a. means for vaporizing a molten flavorant into said air flow;

b. means operatively connected to said vaporizing means for regulating the quantity of flavorant vaporized into said air flow;

c. analyzing means in communication with said air flow downstream of said vaporizing means for analyzing the quantity of flavorant in said air flow; and d. means operatively connected to said regulating means and said analyzing means for controlling said regulating means for varying the quantity of flavorant vaporized in response to the quantity of flavorant contained within the air flow analyzed by said analyzing means.

16. An apparatus recited in claim 15, wherein said analyzing means comprises a by-pass air flow means connected at one end into said air flow system downstream of said vaporizing means for receiving a portion of said air flow and connected at the other end upstream of said vaporizing means for delivering said portion back into said air flow system, said by-pass means having steam coils for reheating said portion of the air flow and an analyzer means operatively connected into said by-pass air flow means for analyzing the amount of flavorant vapor contained in said air flow and transmitting a signal to said regulating means.

* * * * *

UNITED STATES PATENT OFFICE

CERTIFICATE OF CORRECTION

Patent No. 3,991,771 Dated November 16, 1976

Inventor(s) Jon F. Banks

It is certified that error appears in the above-identified patent and that said Letters Patent are hereby corrected as shown below:

Column 1, line 46, change "prior art art apparatus" to --prior art apparatus--.

Column 1, line 67, insert --system-- after "flow".

Column 4, beginning on line 61, delete "The melted flavorant is directed against the heated air flow in duct 60."

Column 5, line 59, insert --8-- after "means".

Column 6, line 7, insert --cyclone-- after "miniature".

Signed and Sealed this

Twenty-second Day of February 1977

[SEAL]

*Attest:*

RUTH C. MASON
*Attesting Officer*

C. MARSHALL DANN
*Commissioner of Patents and Trademarks*